US005464727A

United States Patent [19]

Singer

[11] Patent Number: 5,464,727

[45] Date of Patent: Nov. 7, 1995

[54] CLEANING OF EMULSION MANUFACTURING APPARATUS

[75] Inventor: Douglas E. Singer, Rochester, N.Y.

[73] Assignee: Eastman Kodak Company, Rochester, N.Y.

[21] Appl. No.: 385,530

[22] Filed: Feb. 8, 1995

[51] Int. Cl.[6] ..... G03C 11/24; G03C 1/015

[52] U.S. Cl. ..... 430/347; 430/569; 423/658.5; 423/27; 75/713

[58] Field of Search ..... 239/104; 137/237, 137/246; 430/567, 569, 347; 423/658.5, 27; 75/713

[56] References Cited

U.S. PATENT DOCUMENTS 4,256,704 3/1981 Howard ..... 423/27

5,064,466 11/1991 Hilton ..... 75/417

5,241,992 9/1993 Oehlbeck et al. ..... 137/897

FOREIGN PATENT DOCUMENTS 2-7451 1/1990 Japan .

*Primary Examiner*—Charles L. Bowers, Jr.
*Assistant Examiner*—Mark F. Huff
*Attorney, Agent, or Firm*—Carl F. Ruoff

[57] ABSTRACT

The present invention is a method for cleaning and preparing photographic manufacturing equipment surfaces. An aqueous solution of potassium iodide and ferric ethylenediamine tetraacetate is prepared. The solution is flushed over the surfaces of the photographic manufacturing equipment removing deposited silver halide and silver. A high purity water flush is then performed.

5 Claims, No Drawings

CLEANING OF EMULSION MANUFACTURING APPARATUS

FIELD OF THE INVENTION

The present invention relates to a method for cleaning photographic emulsion manufacturing equipment. More particularly, the present invention is a method for cleaning the surfaces of manufacturing equipment which have solid silver halide and solid silver deposited thereon.

BACKGROUND OF THE INVENTION

In photographic emulsion manufacturing, aqueous solutions of silver nitrate and alkali salt, hereafter referred to collectively as reactants, are delivered separately to a reaction vessel where they combine to form photosensitive silver halide crystals (silver chloride, silver bromide, silver iodide, or combinations thereof) in a precipitation reaction. During this process, metallic silver can be deposited on silver nitrate delivery equipment surfaces as a result of uncontrolled electrochemical reactions involving the silver nitrate solution and conductive equipment surfaces. The metallic silver deposits can interfere with the delivery equipment function and/or contaminate the following batch of product. The primary need for such a metallic silver cleaning process has been created as a result of the recent development and use of smaller and more complicated reactant delivery system components to control the reaction environment in which silver halide crystal growth takes place. Devices such as Apparatus and Method for Distributing Fluid described in U.S. Pat. No. 5,241,992, improve the precipitation yield as a result of improved reactant introduction hydrodynamics which are controlled by small, close-tolerance reactant distribution orifices. The presence of metallic silver fragments in such distribution orifices can severely degrade the performance of the reactant delivery system.

Common cleaning agents known to the photographic industry are usually fixing agents which dissolve silver halide from equipment surfaces. Examples of such agents are thiosulfates, thiocyanates, cyanides, sulfites, concentrated alkali halides, etc. However, these fixing agents, alone or combined, are not effective in dissolving metallic silver. Japanese Kokoku, Patent Number HEI 211990]-7451, refers to a photoprocessing equipment cleaning process using alkali halides combined with a thiosulfate solution. The combined solution dissolves silver halide which is formed in an intermediate cleaning step by reacting the alkali halide solution with silver sulfide sludge on photoprocessing equipment surfaces. The process in the aforementioned Japanese patent removes silver sulfide as an unwanted contaminant which adheres to photoprocessing equipment as a by-product of the film and paper chemical processing reactions. This aforementioned process would not, however, be effective on metallic silver because neither the alkali halide nor the thiosulfate solutions, nor their combination, would sufficiently oxidize metallic silver into a state which could be easily removed from the equipment.

Bleaching agents such as concentrated nitric acid, acidic permanganate, dichromate, persulfate, etc., are effective metallic silver solvents; however, each is disadvantaged for use in high volume cleaning applications due to human toxicity, corrosiveness, potential for sensitometric contamination of product, or environmental hazardousness.

The current invention provides a method for cleaning and preparing photographic manufacturing equipment which has metallic silver and/or silver halide deposited on the surfaces of said equipment.

SUMMARY OF THE INVENTION

The present invention is a method for cleaning and preparing photographic manufacturing equipment surfaces having silver halide and silver deposited thereon. An aqueous solution containing potassium iodide and ferric ethylenediamine tetraacetate (ferric EDTA) is prepared and flushed over the photographic manufacturing equipment surfaces for a time sufficient to remove deposited silver halide and silver from the surfaces. The photographic manufacturing equipment surfaces are then rinsed with high purity water.

In a preferred method of the present invention, the aqueous solution containing potassium iodide and ferric ethylenediamine tetraacetate is heated to approximately 50° C. prior to flushing.

DESCRIPTION OF THE PREFERRED EMBODIMENTS

The process of the present invention involves the preparation of a cleaning solution which contains potassium iodide and ammonium ferric ethylenediamine tetraacetate (EDTA). The principle goal of the current invention is to remove metallic silver from the photographic equipment by first oxidizing it into a state which is more readily processed by subsequent cleaning reactions. Preferably the ferric EDTA is supplied by ammonium ferric EDTA, although other salts of ferric EDTA will work. The iron ion of ammonium ferric EDTA is used as an effective oxidizing agent in the reaction:

$$Ag^0(s)+Fe^{3+}\ (aq)\leftrightharpoons Ag^+\ (aq)+Fe^{2+}(aq) \quad (1)$$

This reaction by itself does not particularly favor the product side of the equation during practical application. In the presence of potassium iodide, however, the iodide ion shifts the equilibrium of Equation (1) to the right by consuming Ag+ to produce AgI:

$$Ag^+(aq)+K^+(aq)+I^-(aq)\leftrightharpoons AgI(s)+K^+(aq) \quad (2)$$

Thus, the addition of potassium iodide allows metallic silver to be converted to silver iodide in practical quantities. In the current invention, the potassium iodide is sufficiently concentrated so that the cleaning reaction readily continues by dissolving the interim product silver iodide of Equation (2) into the potassium iodide by the following complexing process:

$$AgI(s)+nKI(aq)\leftrightharpoons(AgI_{n+1})^{-n}(aq)+nK^+\ (aq)\ \text{where}\ n\geqq 1 \quad (3)$$

If the ammonium ferric EDTA concentration is correctly maintained, the concentrated potassium iodide is still able to dissolve practical amounts of silver chloride, silver bromide, and silver iodide which are unintentionally deposited on the photographic manufacturing equipment as part of the silver halide precipitation reaction.

In order to both dissolve a practical amount of metallic silver and maintain a reaction rate sufficiently large to minimize the required cleaning time, the concentration of the ammonium ferric EDTA in the cleaning solution should be between about 0.1 molar and about 0.5 molar. Ammonium ferric EDTA concentrations below about 0.1 molar require excessive treatment times, and concentrations above about 0.5 molar begin to interfere with the potassium iodide's ability to dissolve silver halide in an emulsion gelatin format. The reaction rate of the metallic silver conversion to silver ion by the ammonium ferric EDTA is also governed by the temperature of the cleaning solution. Significant increases in reaction rate can be realized by increasing the temperature of the cleaning solution from about 20 to about 50 degrees C. In order to maintain the capability to dissolve all silver iodide produced in the conversion of metallic silver by ammonium ferric EDTA and potassium iodide, as well as to dissolve practical amounts of silver halide deposited on the photographic manufacturing equipment surfaces, the concentration of the potassium iodide should be maintained above about 1.5 molar. Due to the cost of potassium iodide as a raw material, its useful life can be prolonged if the solution is initially prepared at concentrations of up to about 4.0 molar. The cost of the additional potassium iodide for the more concentrated initial preparation is more than outweighed by the additional cleaning cycles that can be performed before the potassium iodide concentration falls to 1.5 molar as a result of iodide consumption and process waste encountered during each cleaning cycle.

The cleaning solution of the current invention is circulated through the delivery components (piping, valving, manifolds, distributors, etc.) of the photographic manufacturing equipment in a way that ensures all equipment surfaces are exposed to a sufficient flux of solution for a sufficient amount of time to remove all metallic silver and silver halide from the equipment surfaces. The optimum circulation rate and time is a function of specific equipment geometry, cleaning solution concentration and temperature, and the physical configuration and amount of the metallic silver and silver halide to be removed. Under a typical range of operating conditions, adequate cleaning can be performed with the current invention in about 5 minutes to about 60 minutes. The circulation of the cleaning solution can be done by means of pumping associated with the reactant delivery system itself or by means of pumping from a dedicated cleaning supply and circulation system external to the reactant delivery system.

After circulation of the cleaning solution through the photographic manufacturing equipment is complete, the equipment should be flushed with high purity water in a way that ensures all equipment surfaces are exposed to a sufficient flux of water for a sufficient amount of time to remove all residual cleaning solution from said equipment.

The cleaning solution of the current invention has several benefits relative to the prior art. It is non-corrosive to the photographic manufacturing equipment and the cleaning system equipment. It is non-toxic to human operators. Effluents from the cleaning solution are generally less environmentally damaging than those of the prior art. Because the cleaning solution contains a high concentration of potassium iodide, its residual presence in the photographic manufacturing equipment after flushing can be readily detected by instruments which measure halide ion concentration. Such halide ion sensors are common instrumentation on photographic manufacturing equipment and can be used to detect potential contamination by residual cleaning solution prior to the next preparation of photosensitive product. Many of the metallic silver solvents of the prior art are not detectable with standard photographic manufacturing instrumentation.

EXAMPLE

A representative photographic silver halide emulsion precipitation reactor system was chosen for the cleaning process investigation because it had experienced severe reduction in its performance because metallic silver was collecting in the silver nitrate delivery system and disrupting reactant introduction into the precipitation zone. This phenomenon will be referred to hereafter as "plugging". The subject photographic manufacturing system was equipped with a distributor such as that described in U.S. Pat. No. 5,241,992. Plugging is detected by high pressure in the delivery systems when reactant is delivered at a fixed rate through components which are restricted by metallic silver deposits. Delivery system components are also disassembled and visually inspected for debris and sources of plugging. In the following tests, a cleaning cycle is defined as the circulation of cleaning solution through the reactant delivery system components for 5 minutes followed by a high purity water flush.

During the manufacture of approximately 90 batches of various silver halide emulsions, each silver halide emulsion batch was followed by a cleaning cycle using 2.0 molar potassium iodide at 50 degrees C. At approximately five-batch intervals throughout the 90 batch run, high pressure was indicated in the silver nitrate delivery system. When the silver nitrate delivery system components and distributor were disassembled in response to each high pressure alarm, metallic silver was found on the internal surfaces and in the distribution orifices of said delivery components and distributor. In several instances, delivery channels were completely blocked by silver fragments. The composition of the material was confirmed to be metallic silver by X-ray fluorescence. The metallic silver was manually removed from the delivery system components before they were reassembled and installed.

A new cleaning solution was prepared at 50 degrees C which contained potassium iodide at a concentration of 2.0 molar and ammonium ferric EDTA at a concentration of 0.1 molar. 56 batches of various silver halide emulsions (similar in formula to those of the first 90 batch run) were manufactured, and each emulsion batch was followed by a cleaning cycle. There were no high pressure indications of plugging throughout the entire 56 batch run. The delivery system components and distributor were disassembled for inspection three times during the 56 batch run, and no metallic silver was present on any surfaces at any time. Thus, the metallic silver cleaning process of the current invention was very effective in practical application to photographic manufacturing equipment.

While there has been shown and described what are at present considered to be the preferred embodiments of the present invention, it will be apparent to those skilled in the art that various alterations and modifications can be made herein without departing from the scope of the invention as defined by the appended claims.

What is claimed is:

1. A method for cleaning and preparing photographic manufacturing equipment surfaces having solid silver halide and silver deposited on the photographic manufacturing equipment surfaces comprising:

preparing an aqueous solution containing potassium iodide and ferric ethylenediamine tetraacetate;

flushing the photographic manufacturing equipment surfaces with the aqueous solution containing potassium iodide and ferric ethylenediamine tetraacetate for a time sufficient to remove the deposited silver halide and silver; and flushing the photographic manufacturing equipment surfaces with a high purity water rinse.

2. The method according to claim 1 wherein the solution containing potassium iodide and ferric ethylenediamine tetraacetate has a concentration of 1.5 to about 4.0 molar potassium iodide.

3. The method according to claim 1 wherein the solution containing potassium iodide and ferric ethylenediamine tetraacetate has a concentration of 0.1 to about 0.5 molar ferric ethylenediamine tetraacetate.

4. The method according to claim 1 wherein the time sufficient to remove the deposited silver halide and silver is from about 5 minutes to about 60 minutes.

5. The method according to claim 1 further comprising:

heating the aqueous solution containing potassium iodide and ferric ethylenediamine tetraacetate to a temperature of about 50° C. prior to flushing the manufacturing equipment with the aqueous solution.

* * * * *